US006741212B2

(12) United States Patent
Kralovec et al.

(10) Patent No.: US 6,741,212 B2
(45) Date of Patent: May 25, 2004

(54) LOW PROFILE DIELECTRICALLY LOADED MEANDERLINE ANTENNA

(75) Inventors: Jay A. Kralovec, Melbourne, FL (US); Jason M. Hendler, Indian Harbor Beach, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 10/160,930

(22) Filed: May 31, 2002

(65) Prior Publication Data

US 2003/0052826 A1 Mar. 20, 2003

Related U.S. Application Data

(60) Provisional application No. 60/364,922, filed on Mar. 15, 2002, and provisional application No. 60/322,837, filed on Sep. 14, 2001.

(51) Int. Cl.[7] ..... H01Q 1/38
(52) U.S. Cl. ..... 343/700 MS; 343/702
(58) Field of Search ..... 343/700 MS, 702, 343/742, 895, 741

(56) References Cited

U.S. PATENT DOCUMENTS

| | | | |
|---|---|---|---|
| 3,742,393 | A | 6/1973 | Karp |
| 3,925,738 | A | 12/1975 | Bates et al. |
| 4,435,689 | A | 3/1984 | McDowell |
| 4,465,988 | A | 8/1984 | Moats |
| 4,495,503 | A | 1/1985 | Morman |
| 4,546,357 | A | 10/1985 | Laughon et al. |
| 4,692,727 | A | 9/1987 | Wakino et al. |
| 4,764,771 | A | 8/1988 | Sterns |
| 4,847,625 | A | 7/1989 | Dietrich et al. |
| 5,313,216 | A | 5/1994 | Wang et al. |
| 5,406,233 | A | 4/1995 | Shih et al. |
| 5,497,164 | A | 3/1996 | Croq |
| 5,504,466 | A | 4/1996 | Chan-Son-Lint et al. |
| 5,566,441 | A | 10/1996 | Marsh et al. |
| 5,680,144 | A | 10/1997 | Sanad |
| 5,768,217 | A | 6/1998 | Sonoda et al. |
| 5,790,080 | A | 8/1998 | Apostolos |
| 5,874,919 | A | 2/1999 | Rawnick et al. |
| 5,973,598 | A | 10/1999 | Beigel |
| 6,005,525 | A | 12/1999 | Kivela |
| 6,016,122 | A | 1/2000 | Malone et al. |
| 6,094,170 | A | 7/2000 | Peng |

(List continued on next page.)

OTHER PUBLICATIONS

Harrington, Roger F., Effect of Antenna Size on Gain, Bandwidth, and Efficiency, Journal of Research of the National Bureau of Standards—D. Radio Propagation, vol. 64D, No. 1, Jan.–Feb. 1960.

(List continued on next page.)

*Primary Examiner*—Shih-Chao Chen
(74) *Attorney, Agent, or Firm*—John L. DeAngelis, Jr.; Beusse Brownlee Wolter Mora & Maire, P.A.

(57) ABSTRACT

An antenna having a plurality of conductive layers formed on a dielectric substrate. A ground plate and a feed plate are oriented in substantially parallel relation on two opposing sides of the dielectric substrate. A top plate, which is electrically connected to the ground plate and electrically insulated from the feed plate, is disposed on a third surface of the dielectric substrate perpendicular to the first and the second surfaces. One or more conductive layers are also disposed within the interior of the dielectric substrate parallel to the first and the second surfaces. One or more conductive vias extend between the feed plate and the ground plate through the interior of the dielectric substrate. In various embodiments these conductive vias are connected to one or more of the feed plate, the ground plate, and the interior conductive surfaces.

32 Claims, 8 Drawing Sheets

U.S. PATENT DOCUMENTS

| | | | | |
|---|---|---|---|---|
| 6,107,920 | A | | 8/2000 | Eberhardt et al. |
| 6,137,453 | A | | 10/2000 | Wang et al. |
| 6,147,662 | A | | 11/2000 | Grabau et al. |
| 6,166,694 | A | | 12/2000 | Ying |
| 6,215,229 | B1 | | 4/2001 | Kuroda et al. |
| 6,232,923 | B1 | | 5/2001 | Guinn et al. |
| 6,252,550 | B1 | | 6/2001 | Vernon |
| 6,259,369 | B1 | | 7/2001 | Monico |
| 6,313,716 | B1 | | 11/2001 | Apostolos |
| 6,323,814 | B1 | | 11/2001 | Apostolos |
| 6,486,844 | B2 | * | 11/2002 | Thursby et al. ..... 343/744 |
| 6,504,508 | B2 | * | 1/2003 | Apostolos ..... 343/700 MS |
| 6,556,169 | B1 | * | 4/2003 | Fukuura et al. ..... 343/700 MS |

OTHER PUBLICATIONS

Harvey, A. F., Periodic and Guiding Structures at Microwave Frequencies, IRE Transactions on Microwave Theory and Techniques, Jan. 1960, pp. 30–61.

Apostolos, Multi–Layer, Wideband Meander Line Loaded Antenna, U.S. patent application Publication, Pub. No. US 2001/0048394 A1, Dec. 6, 2001.

Kayanakis, Contactless or Hybrid Contact–Contactless Smart Card Designed to Limit the Risks of Fraud, U.S. patent application Publication, Pub. No. US 2001/0002035 A1, May 31, 2001.

* cited by examiner

LOW PROFILE DIELECTRICALLY LOADED MEANDERLINE ANTENNA

CROSS-REFERENCE TO RELATED PATENT APPLICATIONS

This patent application claims the benefit of provisional patent application No. 60/322,837 filed on Sep. 14, 2001 and provisional patent application No. 60/364,922 filed on Mar. 15, 2002.

BACKGROUND OF THE INVENTION

It is generally known that antenna performance is dependent upon the antenna size, shape, and the material composition of certain antenna elements, as well as the relationship between the wavelength of the received or transmitted signal and certain antenna physical parameters (e.g., length for a linear antenna and diameter for a loop antenna). These relationships and physical parameters determine several antenna performance characteristics, including input impedance, gain, directivity, polarization and the radiation pattern. Generally, for an operable antenna, the minimum physical antenna dimension (or the minimum effective electrical length) must be on the order of a quarter wavelength (or a multiple thereof) of the operating frequency, which thereby limits the energy dissipated in resistive losses and maximizes the energy transmitted. Quarter wave length and half wave length antennae are the most commonly used.

The burgeoning growth of wireless communications devices and systems has created a substantial need for physically smaller, less obtrusive, and more efficient antennas that are capable of wide bandwidth or multiple frequency band operation, and/or operation in multiple modes, i.e., selectable signal polarizations or radiation patterns. As the physical enclosures for pagers, cellular telephones and wireless Internet access devices (e.g., PCMCIA cards for laptop computers) shrink, manufacturers continue to demand improved performance, multiple operational modes and smaller sizes for today's antennae. It is indeed a difficult objective to achieve these features while shrinking the antenna size.

Smaller packaging of state-of-the-art communications devices does not provide sufficient space for the conventional quarter and half wavelength antenna elements. As is known to those skilled in the art, there is a direct relationship between physical antenna size and antenna gain, at least with respect to a single-element antenna, according to the relationship: gain=(βR)^2+2βR, where R is the radius of the sphere containing the antenna and β is the propagation factor. Increased gain thus requires a physically larger antenna, while users continue to demand physically smaller antennas. As a further constraint, to simplify the system design and strive for minimum cost, equipment designers and system operators prefer to utilize antennas capable of efficient multi-frequency and/or wide bandwidth operation. Finally, gain is limited by the known relationship between the antenna frequency and the effective antenna length (expressed in wavelengths). That is, the antenna gain is constant for all quarter wavelength antennas of a specific geometry i.e., at that operating frequency where the effective antenna length is a quarter wavelength of the operating frequency.

One basic antenna commonly used in many applications today is the half-wavelength dipole antenna. The radiation pattern is the familiar donut shape with most of the energy radiated uniformly in the azimuth direction and little radiation in the elevation direction. Frequency bands of interest for certain wireless communications devices include 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi.

A derivative of the half-wavelength dipole is the quarter-wavelength monopole antenna placed above a ground plane. The physical antenna length is a quarter-wavelength, but the ground plane creates an effective half-wavelength dipole and therefore the antenna characteristics resemble those of a half-wavelength dipole, that is the radiation pattern shape for the quarter-wavelength monopole above a ground plane is similar to the half-wavelength dipole pattern, with a typical gain of approximately 2 dBi.

The common free space (i.e., not above ground plane) loop antenna (with a diameter of approximately one-third the wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics.

Another conventional antenna is the patch, which provides directional hemispherical coverage with a gain of approximately 3 dBi. Although small compared to a quarter or half wavelength antenna, the patch antenna has a relatively narrow bandwidth.

Given the advantageous performance of a quarter and half wavelength antennas, prior art antennas have typically been constructed with elemental lengths on the order of a quarter wavelength of the radiating frequency with the antenna operated above a ground plane. These dimensions allow the antenna to be easily excited and to be operated at or near a resonant frequency, limiting the energy dissipated in resistive losses and maximizing the transmitted energy. But, as the operational frequency increases/decreases, the operational wavelength decreases/increases and the antenna element dimensions proportionally decrease/increase.

Thus antenna designers have turned to the use of so-called slow wave structures where the structure physical dimensions are not equal to the effective electrical dimensions. Recall that the effective antenna dimensions should be on the order of a half wavelength (or a quarter wavelength above a ground plane) to achieve the beneficial radiating and low loss properties discussed above. Generally, a slow-wave structure is defined as one in which the phase velocity of the traveling wave is less than the free space velocity of light. The wave velocity is the product of the wavelength and the frequency and takes into account the material permittivity and permeability, i.e., $c/((\mathrm{sqrt}(\in_r)\mathrm{sqrt}(\mu_r))=\lambda.f$. Since the frequency remains unchanged during propagation through a slow wave structure, if the wave travels slower (i.e., the phase velocity is lower) than the speed of light, the wavelength within the structure is smaller than the free space wavelength. Thus, for example, a half wavelength slow wave structure is shorter than a half wavelength structure where the wave propagates at the speed of light (c). The slow-wave structure de-couples the conventional relationship between physical length, resonant frequency and wavelength. Slow wave structures can be used as antenna elements (e.g., feeds) or as antenna radiating structures.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole, for instance, then the structure propagating the slow wave will be physically smaller than the structure propagating the wave at the speed of light.

Slow wave structures are discussed extensively by A. F. Harvey in his paper entitled *Periodic and Guiding Structures at Microwave Frequencies*, in the IRE Transactions on Microwave Theory and Techniques, January 1960, pp. 30–61 and in the book entitled *Electromagnetic Slow Wave Systems* by R. M. Bevensee published by John Wiley and Sons, copyright 1964. Both of these references are incorporated by reference herein.

A transmission line or conductive surface on a dielectric substrate exhibits slow-wave characteristics, such that the effective electrical length of the slow-wave structure is greater than its actual physical length according to the equation, $$l_e=(\in_{eff}^{1/2})\times l_p,$$

where $l_e$ is the effective electrical length, $l_p$ is the actual physical length, and $\in_{eff}$ is the dielectric constant ($\in_r$) of the dielectric material proximate the transmission line.

A prior art meanderline, which is one example of a slow wave structure, comprises a conductive pattern (i.e., a traveling wave structure) over a dielectric substrate, overlying a conductive ground plane. An antenna employing a meanderline structure, referred to as a meanderline-loaded antenna (MLA) or a variable impedance transmission line (VITL) antenna, is disclosed in U.S. Pat. No. 5,790,080. The antenna consists of two vertical spaced apart conductors and a horizontal conductor disposed therebetween, with a gap separating each vertical conductor from the horizontal conductor.

The MLA was developed to de-couple the conventional relationship between the antenna physical length and resonant frequency based on the free-space wavelength.

The antenna further comprises one or more meanderline variable impedance transmission lines bridging the gap between the vertical conductor and each horizontal conductor. Each meanderline couplet is a wave transmission line structure carrying a traveling wave at a velocity less than the free space velocity. Thus the effective electrical length of the slow wave structure is considerably greater than it's actual physical length. Consequently, smaller antenna elements can be employed to form an antenna having, for example, quarter wavelength properties. As for all antenna structures, the antenna resonant condition is determined by the electrical length of the meanderlines plus the electrical length of the radiating structures.

Although the meanderline antenna described above is relatively narrowband in operation, one technique for achieving broadband operation provides for electrically shortening the meanderlines to change the resonant antenna frequency. In such an embodiment the slow-wave meanderline structure includes separate switchable segments (controlled, for example, by vacuum relays, MEMS (micro-electro-mechanical systems), PIN diodes or mechanical switches) that can be inserted in and removed from the circuit by action of the associated switch. This switching action changes the effective electrical length of the meanderline coupler and thus changes the effective length of the antenna and its resonant characteristics. Losses are minimized in the switching process by placing the switching structure in the high impedance sections of the meanderline. Thus the current through the switching device is low, resulting in very low dissipation losses and a high antenna efficiency.

In lieu of removing and adding meanderline segments to the antenna by switching devices as described above, the antenna can be constructed with multiple selectable meanderlines to control the effective antenna electrical length. These are also switched into and removed from the antenna using the switching devices described above.

Consequently, smaller antenna elements can be employed to form an antenna having, for example, quarter-wavelength properties. As for all antenna structures, the antenna resonant condition is determined by the electrical length of the meanderlines plus the electrical length of the radiating elements.

The meanderline-loaded antenna allows the physical antenna dimensions to be reduced, while maintaining an effective electrical length that, in one embodiment, is a quarter wavelength multiple. The meanderline-loaded antennas operate in the region where the performance is limited by the Chu-Harrington relation, that is, $$\text{efficiency}=FVQ,$$

where:

Q=quality factor

V=volume of the structure in cubic wavelengths

F=geometric form factor (F=64 for a cube or a sphere)

Meanderline-loaded antennas achieve this efficiency limit of the Chu-Harrington relation while allowing the effective antenna length to be less than a quarter wavelength at the resonant frequency. Dimension reductions of 10 to 1 can be achieved over a quarter wavelength monopole antenna, while achieving a comparable gain.

BRIEF SUMMARY OF THE INVENTION

A meanderline antenna such as described above, offers desirable attributes within a smaller physical volume than prior art antennas, while exhibiting comparable or enhanced performance over conventional antennas. To gain additional benefits from the use of these meanderline antennas, it is advantageous to minimize the space occupied by the antenna and further to provide the antenna at a lower cost through the use of more efficient antenna construction techniques.

In addition to smaller size, antenna designers strive to minimize manufacturing and assembly costs. Thus it is desirable to develop an antenna design that comprises easily reproducible manufacturing steps, minimizes human labor in the manufacturing process and allows easy integration and assembly of the antenna into the final product.

Thus according to the teachings of the present invention, an antenna is constructed from a plurality of dielectric layers, and further includes conductive surfaces thereon serving as the feed, radiating element and the ground plane. The various conductive surfaces are patterned to achieve the desired antenna performance. In certain embodiments of the present invention, inner facing surfaces of the dielectric layers are also patterned with conductive traces to produce the desired antenna characteristics.

BRIEF DESCRIPTION OF THE DRAWINGS

The present invention can be more easily understood and the further advantages and uses there are more readily apparent, when considered in view of the detailed description of the preferred embodiments and the following figures in which.

DETAILED DESCRIPTION OF THE INVENTION

Figure 1:
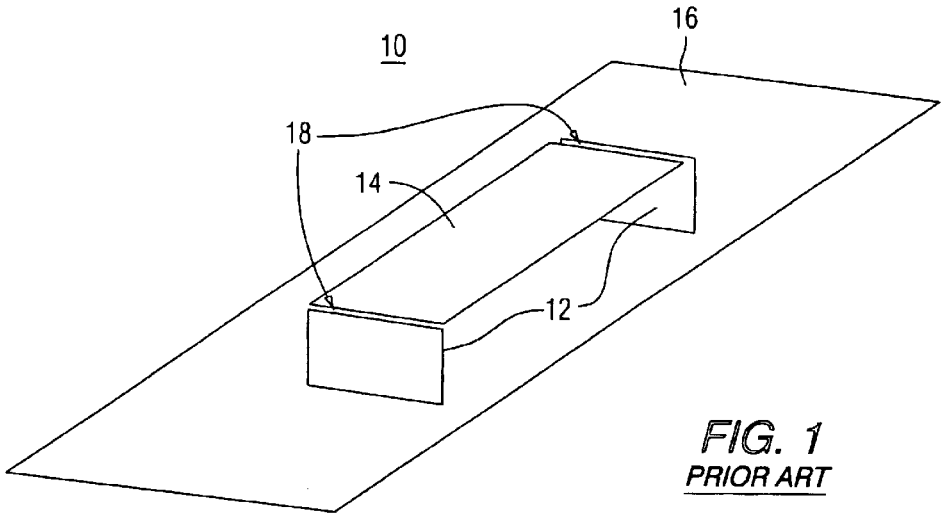
FIG. 1 PRIOR ART
FIG. 1 is a perspective view of the meanderline-loaded antenna of the prior art.

Before describing in detail the particular dielectrically-loaded antenna constructed according to the teachings of the present invention, it should be observed that the present invention resides primarily in a novel and non-obvious combination of method steps and elements related to antennas structures and antenna technology in general. Accordingly, the hardware components and method steps described herein have been represented by conventional elements in the drawings and in the specification description, showing only those specific details that are pertinent to the present invention, so as not to obscure the disclosure with details that will be readily apparent to those skilled in the art having the benefit of the description herein.

A schematic representation of a prior art meanderline-loaded antenna 10 is shown in a perspective view in FIG. 1. Generally, the meanderline-loaded antenna 10 includes two vertical conductors 12, a horizontal conductor 14, and a ground plane 16. The vertical conductors 12 are physically separated from the horizontal conductor 14 by gaps 18, but are electrically connected to the horizontal conductor 14 by two meanderline couplers, (not shown) one for each of the two gaps 18, to thereby form an antenna structure capable of radiating and receiving RF (radio frequency) energy. The meanderline couplers electrically bridge the gaps 18 and, in one embodiment, have controllably adjustable lengths for changing the characteristics of the meanderline-loaded antenna 10. In one embodiment of the meanderline coupler, segments of the meanderline can be switched in or out of the circuit quickly and with negligible loss, to change the effective length of the meanderline couplers, thereby changing the effective antenna length and thus the antenna performance characteristics. The switching devices are located in high impedance sections of the meanderline couplers, minimizing the current through the switching devices, resulting in low dissipation losses in the switching device and maintaining high antenna efficiency.

The operational parameters of the meanderline-loaded antenna 10 are affected by the input signal wavelength (i.e., the signal to be transmitted by the antenna) relative to the antenna effective electrical length (i.e., the sum of the meanderline coupler lengths plus the antenna element lengths). According to the antenna reciprocity theorem, the antenna operational parameters are also substantially affected by the received signal frequency. Two of the various modes in which the antenna can operate are discussed herein below.

Figure 2:
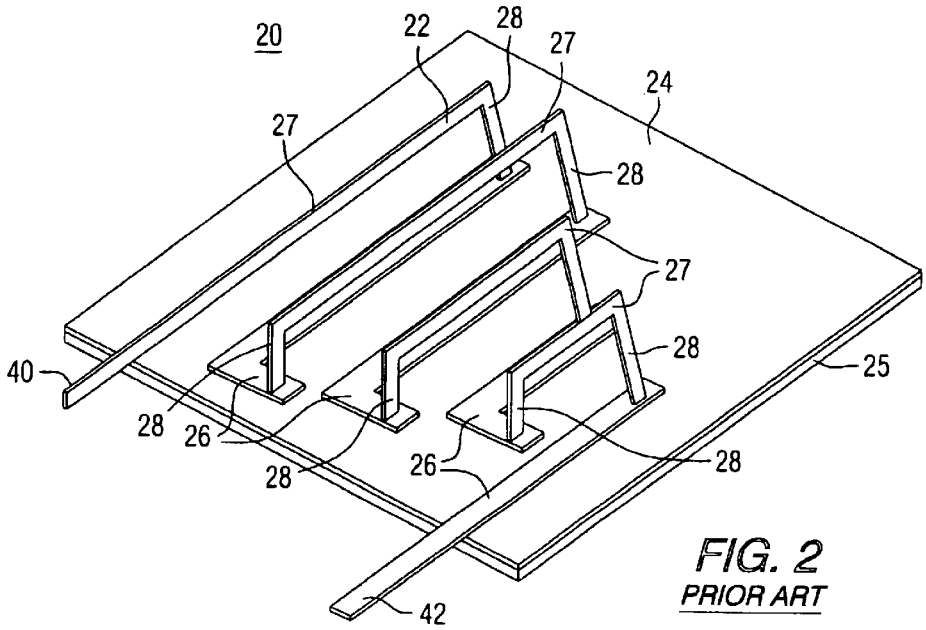
FIG. 2 PRIOR ART
FIG. 2 illustrates a meanderline coupler for use with the meanderline-loaded antenna of FIG. 1.

FIG. 2 shows a perspective view of a meanderline coupler 20 constructed for use in conjunction with the meanderline-loaded antenna 10 of FIG. 1. Two meanderline couplers 20 are generally required for use with the meanderline-loaded antenna 10; one meanderline coupler 20 bridging each of the gaps 18 illustrated in FIG. 1. However, it is not necessary for the two meanderline couplers to have the same physical (or electrical) length. The meanderline coupler 20 of FIG. 2 is a slow wave meanderline element (or variable impedance transmission line) in the form of a folded transmission line 22 mounted on a dielectric substrate 24, which is in turn mounted on a plate 25. In one embodiment, the transmission line 22 is constructed from microstrip line. Sections 26 are mounted close to the substrate 24; sections 27 are spaced apart from the substrate 24. In one embodiment as shown, sections 28, connecting the sections 26 and 27, are mounted orthogonal to the substrate 24. The variation in height of the alternating sections 26 and 27 from the substrate 24 gives the sections 26 and 27 different impedance values with respect to the substrate 24. As shown in FIG. 2, each of the sections 27 is approximately the same distance above the substrate 24. However, those skilled in the art will recognize that this is not a requirement for the meanderline coupler 20. Instead, the various sections 27 can be located at differing distances above the substrate 24. Such modifications change the electrical characteristics of the coupler 20 from the embodiment employing uniform distances. As a result, the characteristics of the antenna employing the coupler 20 are also changed. The impedance presented by the meanderline coupler 20 can be changed by changing the material or thickness of the substrate 24 or by changing the width of the sections 26, 27 or 28. In any case, the meanderline coupler 20 must present a controlled (but controllably variable if the embodiment so requires) impedance. The effective electrical length of the meanderline coupler 20 is also changed by changing these physical parameters.

The sections 26 are relatively close to the substrate 24 (and thus the plate 25) to create a lower characteristic impedance. The sections 27 are a controlled distance from the substrate 24, wherein the distance determines the characteristic impedance and frequency characteristics of the section 27 in conjunction with the other physical characteristics of the folded transmission line 22.

Figure 3:
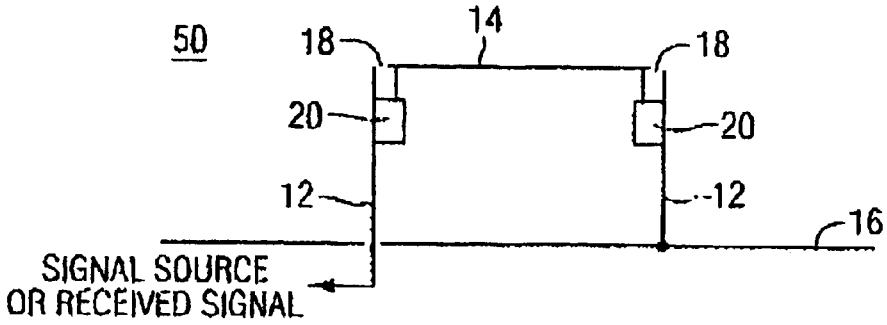
FIG. 3 PRIOR ART
FIG. 3 is a schematic representation of a meanderline-loaded antenna of FIG. 1.

The meanderline coupler 20 includes terminating points 40 and 42 for connection to the elements of the meanderline-loaded antenna 10. Specifically, FIG. 3 illustrates two meanderline couplers 20, one affixed to each of the vertical conductors 12 such that the vertical conductor 12 serves as the plate 25 from FIG. 2, forming a meanderline-loaded antenna 50. One of the terminating points shown in FIG. 2, for instance the terminating point 40, is connected to the horizontal conductor 14 and the terminating point 42 is connected to the vertical conductor 12. The second of the two meanderline couplers 20 illustrated in FIG. 3 is configured in a similar manner.

The operating mode of the meanderline-loaded antenna 50 of FIG. 3 depends upon the relationship between the operating frequency and the effective electrical length of the antenna elements, including the meanderline couplers 20 and the other antenna elements. Thus the meanderline-loaded antenna 50, like all antennae, exhibits operational characteristics as determined by the ratio between the effective electrical length and the transmit signal frequency in the transmitting mode or the received frequency in the receiving mode.

Figure 4:
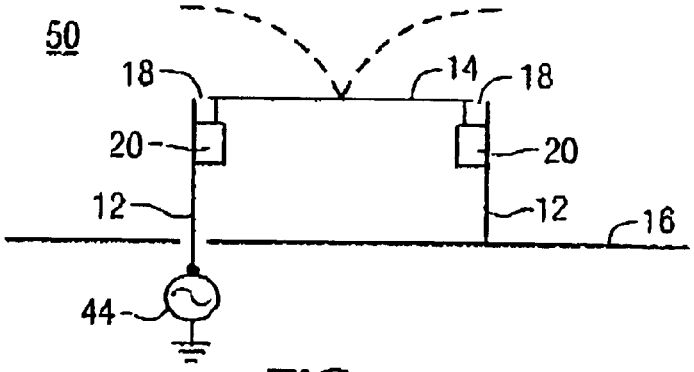
FIG. 4 PRIOR ART
FIGS. 4–7 illustrate exemplary antenna radiation patterns for the meanderline-line loaded antenna of FIG. 3.
Figure 5:
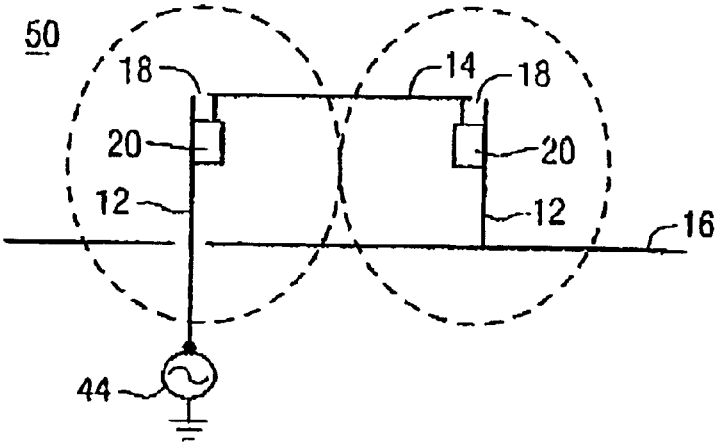
FIG. 5 PRIOR ART

Turning to FIGS. 4 and 5, there is shown the current distribution (FIG. 4) and the antenna electric field radiation pattern (FIG. 5) for the meanderline-loaded antenna 50 operating in a monopole or half wavelength mode (i.e., the effective electrical length is about one-half wavelength) as driven by an input signal source 44. That is, in this mode, at a given frequency, the effective electrical length of the meanderline couplers 20, the horizontal conductor 14 and the vertical conductors 12 is chosen such that the horizontal conductor 14 has a current null near the center and current maxima at each edge. As a result, a substantial amount of radiation is emitted from the vertical conductors 12, and little radiation is emitted from the horizontal conductor 14. The resulting field pattern has the familiar omnidirectional donut shape as shown in FIG. 5.

Those skilled in the art will appreciate that the desired operational frequency is determined by the dimensions, geometry and material of the antenna components (i.e., the meanderline couplers 20, the horizontal conductor 14, the vertical conductors 12 and the ground plane 16). Thus these elements can be modified by the antenna designer to create an antenna having different antenna characteristics at other frequencies or frequency bands.

Figure 6:
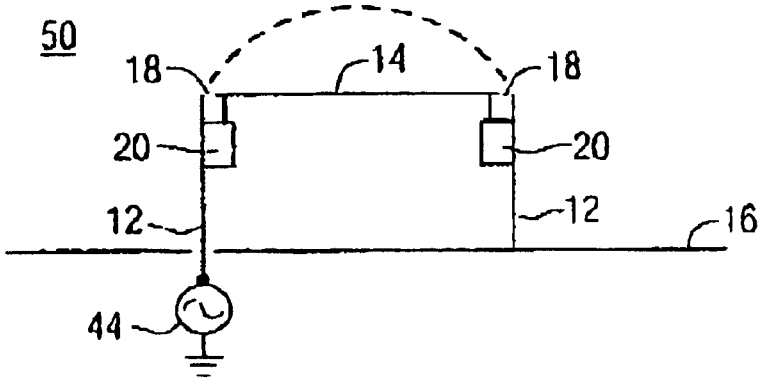
FIG. 6 PRIOR ART
Figure 7:
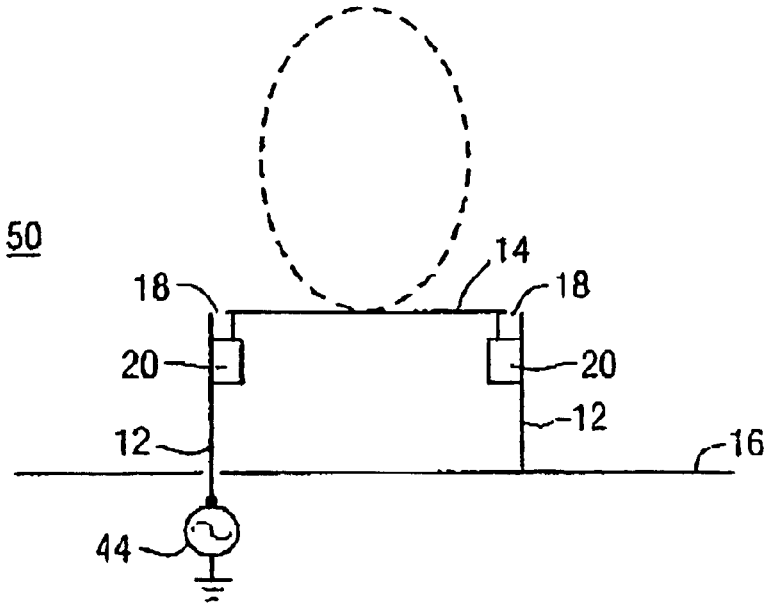
FIG. 7 PRIOR ART

A second exemplary operational mode for the meanderline-loaded antenna 50 is illustrated in FIGS. 6 and 7. This mode is the so-called loop mode, operative when the ground plane 16 is electrically large compared to the effective length of the antenna and wherein the effective electrical length is about one wavelength at the operating frequency. In this mode the current maximum occurs approximately at the center of the horizontal conductor 14 (see FIG. 6) resulting in an electric field radiation pattern as illustrated in FIG. 7.

The antenna characteristics displayed in FIGS. 6 and 7 are based on an antenna of twice the effective electrical length (including the length of the meanderline couplers 20) as the antenna depicted in FIGS. 4 and 5. An antenna incorporating meanderline couplers 20 can be designed to operate in either of the modes described above FIG. 8 illustrates a front view and FIG. 9 illustrates a rear view of a low profile dielectrically loaded meanderline antenna 60 constructed according to the teachings of the present invention. In this embodiment, the antenna 60 comprises three dielectric layers 61, 62 and 63, a top plate 66, a feed plate 68 and an oppositely-disposed ground plate 70. By using the dielectric material of the dielectric layers 61, 62 and 63 to load the antenna 60, as compared to the prior art MLA antenna that is air-loaded, the overall antenna size is reduced for a given operational frequency. Generally, in FIGS. 8 through 25, the conductive material is indicated by cross hatching and the dielectric material is shown without indicative markings.

It is not required that the three dielectric layers 61, 62 and 63 have equal dielectric constants. In one embodiment the dielectric layer 62 is formed from a material with a higher dielectric constant to increase the effective electrical length of the antenna without increasing its physical dimensions. A dielectric constant greater than about 4 for each of the layers is suitable. In one embodiment of the present invention, the material of the dielectric layers 61, 62 and 63 comprises FR-4, commonly used for printed circuit boards. The use of different dielectric materials or those with a different dielectric constant will produce an antenna having performance properties different than those presented herein.

The dielectric layers 61 and 63 have patterned conductive material on the interior-facing surfaces 74 and 76 thereof. These patterned material layers are described further below. In one embodiment the dielectric layer 62 has no conductive features on the two interior surfaces.

Loading the meanderline antenna with a solid dielectric material comprising the dielectric layers 61, 62 and 63 and disposing the conductive surfaces thereon allows the employment of repeatable manufacturing steps during the manufacturing process of the antenna 60, which in turn provides improved quality control over the various element dimensions and assures realization of expected antenna performance. For example, printed circuit board fabrication techniques can be employed to form the patterned conductive material on the surfaces 74 and 76.

To provide a ground plane surface for the antenna 60, the ground plate 70 electrically contacts the ground plane of the device in which the antenna 60 is inserted (for instance a PCMCIA card) by way of ground contacts 80 and 82. The nature and location of the ground contacts 80 and 82 is discussed further below. The input signal is provided to the antenna 60 in the transmit mode (or received from the antenna 60 in the receive mode) at a feed contact 84 in electrical connection with the feed plate 68. The patterned conductive feed plate 68 is formed (preferably by etching) on the outer surface of the dielectric layer 63.

In one embodiment, the antenna 60 includes vias 90 and 92. The via 90 is electrically connected to the feed plate 68 and the via 92 is conductively isolated from the feed plate 68, but is electromagnetically coupled to the feed plate 68 due to relatively small gap 96 between the conductive material of the feed plate 68 and the via 92. The vias 90 and 92 operate as meanderline couplers between the various antenna elements.

In one embodiment the top plate 66 is electrically connected to a continuous conductive strip 98 extending along the front surface of the dielectric layer 63 lying above and electrically insulated from the upper edge of the feed plate 68. Due to the proximity between the conductive strip 98 and the feed plate 68, there is electromagnetic coupling between these two elements.

The rear surface of the antenna 60 is illustrated in FIG. 9, including the patterned ground plate 70 disposed on the outwardly facing surface of the dielectric layer 61. As can be seen, the via 90 is conductively connected to the ground plate 70 and the via 92 is electromagnetically coupled to the ground plate 90. The ground plate 90 is also electrically connected to the top plate 66 along an edge 100 where these two elements contact. A cut-out region 102 along the bottom surface of the ground plate 70 avoids electrical contact between the feed contact 84 running along the bottom surface of the antenna 60 and the ground plate 70.

Figure 8:
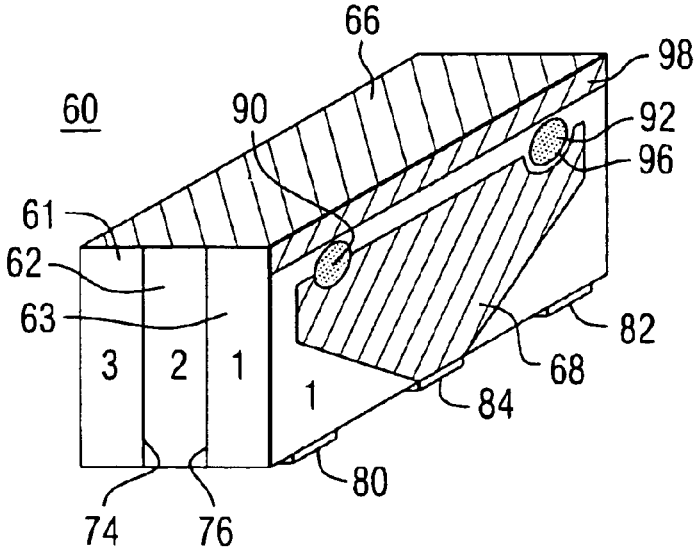
FIGS. 8–10 are perspective views of a low-profile dielectrically-loaded meanderline antenna constructed according to the teachings of the present invention.
Figure 9:
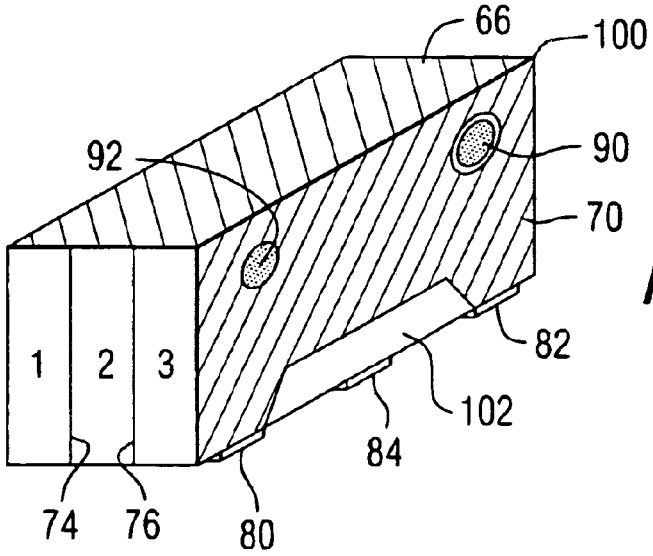

Although a specifically-shaped feed plate 68 and a ground plate 70 are shown in FIG. 8, it is known by those skilled in the art that other geometric shapes will also produce desired antenna operational characteristics as determined by the current flow within the various conductive surfaces comprising the antenna 60.

Figure 10:
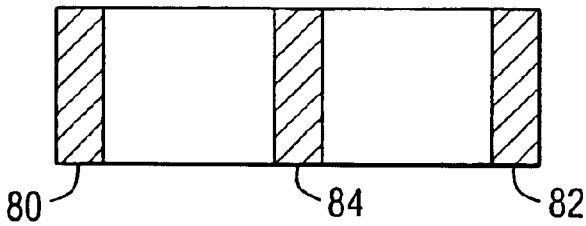

The ground contacts 80 and 82 and the feed contact 84 of the antenna 60 are also shown in the bottom view of FIG. 10 The ground contacts are conductively connected to the antenna ground plate 70 and the feed contact is conductively connected to the feed plate 68. Advantageously, the antenna 60 can be placed onto a patterned printed circuit board (by available pick and place assembly machines) such that the ground contacts 80 and 82 and the feed contact 84 are mated with the appropriate signal and ground conductive traces on the board. The antenna 60 is physically and electrically attached by a reflow or wave solder operation that attaches the ground contacts 80 and 82 and the feed contact 84 to the appropriate conductive trace.

Figure 11:
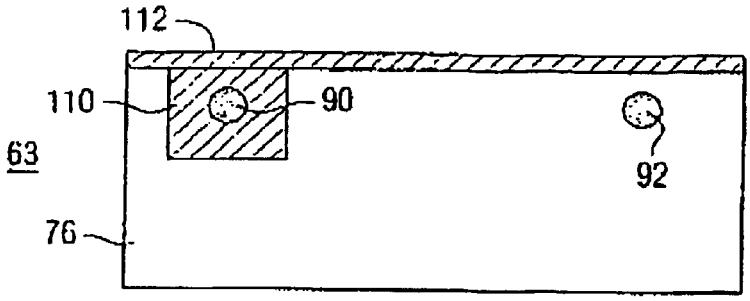
FIGS. 11 and 12 illustrate patterned interior surface configurations of a low-profile dielectrically-loaded meanderline antenna constructed according to the teachings of the present invention.
Figure 12:
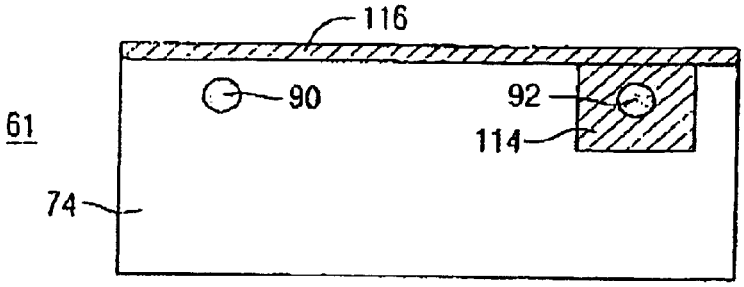

Exemplary conductive patterns for the surfaces 76 and 74 are shown in FIGS. 11 and 12. On the surface 76 of the layer 63 shown in FIG. 11, the via 90 is surrounded by and electrically connected to a conductive pad 110, which in turn is electrically connected to a continuous conductive strip 112. The conductive strip 112 provides electrical connection between the via 90, and the conductive pad 110 to the top plate 66. Also, since in one embodiment the top plate 66 is formed by electroplating, the conductive strip 112 serves as a physical attachment surface for the top plate during the electroplating process. As a result, the top plate 68 is less likely to separate from the top surface of each of the dielectric layers 61, 62 and 63. The via 92 is not connected to the patterned layer 76.

The surface 74 of the layer 61 is illustrated in FIG. 12. The via 90 passes therethrough, while the via 92 is electrically connected to a conductive pad 114 and thence to a conductive strip 116 formed (preferably by etching) along the top edge of the of the surface 74. The conductive strip 116 provides an electrical and mechanical connection to the top plate 66. In addition to the conductive connection between the vias 90 and 92 and the top plate 66, both the vias 90 and 92 are also electromagnetically coupled to the top plate 66 since they are located proximate thereto.

The vias 90 and 92 serve as the meanderlines of the low profile dielectrically loaded meanderline antenna 60. According to the present invention these meanderlines are non-symmetric because the only electrical connection from the feed plate 68 to the top plate 66 is by way of the via 90. However, the ground plate 70 is connected both directly to the top plate 66 (see the rear view of FIG. 8) and further connected to the top plate 66 through via 92 through the conductive pad 114 and the conductive strip 116 as illustrated in FIG. 12.

Figure 13:
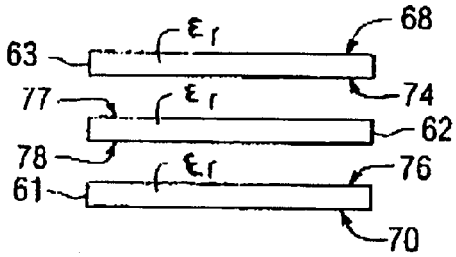
FIG. 13 is an exploded view of the dielectric layers of one embodiment of a low-profile dielectrically-loaded meanderline antenna constructed according to the teachings of the present invention.

FIG. 13 is an exploded view of the three dielectric layers 61, 62 and 63 and indicates the orientation of the surfaces 74 and 76, the feed plate 68 and the ground plate 70. As described above, the surfaces 74 and 76 carry conductive patterns. In another embodiment, the conductive patterns are disposed on surfaces 77 and 78 of the dielectric layer 62, rather than on the surfaces 74 and 76 of the dielectric layers 63 and 61, respectively.

To form the antenna 60 according to the present invention, the surfaces 74 and 76 are patterned and etched according to the intended conductor pattern artwork. Also, the outer-facing surface of the dielectric layers 61 and 63, are patterned and etched to form the ground plate 70 and the feed plate 68 and the conductive strip 98.

Figure 14:
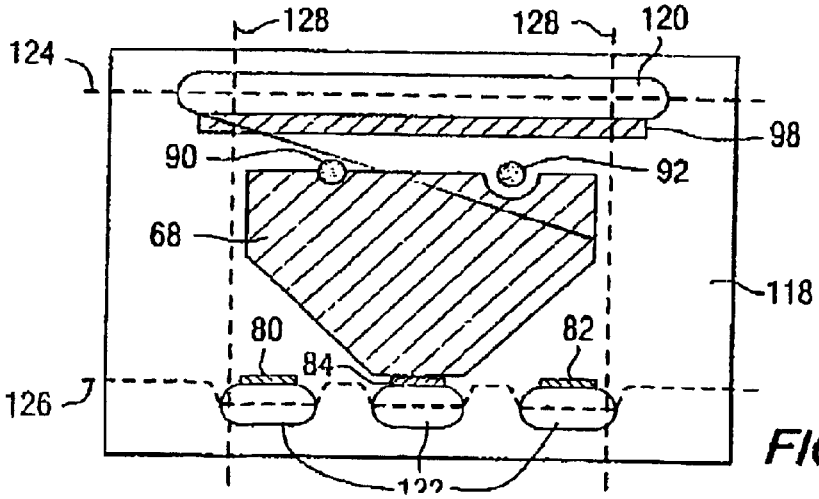
FIGS. 14 and 15 illustrate surface features of a low-profile dielectrically-loaded meanderline antenna constructed according to the teachings of the present invention.

The dielectric layers 61, 62 and 63 are then laminated (for instance, using a pre-pregnated dielectric material applied to the mating surfaces) to form a laminated bulk 118, and predetermined areas are drilled or routed to form openings at the location of the vias 90 and 92, a slot 120 and slots 122 as shown in FIG. 14. The laminated bulk 118 is plated with preferably 1.5 ounces of copper. The vias 90 and 92 are thus formed and the interior surface of the slot 120 and the slots 122 are also plated during this process. During this plating process, material "grows" from the conductive strips 98, 112 and 116 to form an electrical connection with the top plate 66, which is formed by plating within the slot 120. The plated material within the slots 122 forms the ground contacts 80 and 82 and the feed contact 84.

After the etching process has been completed, all solder masks, finish plates, and silk screen stencils are applied to the laminated bulk 118, as is well known in the art.

Typically, a plurality of antennas 60 are simultaneously formed, and thus the laminated bulk 118 must be routed or diced to separate the individual antennas. See for example dashed lines 124, 126 and 128 of FIG. 14 that represent cut lines for forming an individual antenna 60 from the laminated bulk 118. As can be seen, the plated area within the slot 120 forms the top plate 66 when the laminated bulk is cut along the dashed line 124. The feed contact 84 and the ground contacts 80 and 82 are formed when the laminated bulk 118 is cut along the dashed line 126. The laminated bulk 118 is also cut along the dashed lines 128 to complete the formation of the antenna 60.

Automated pick and place machines will typically be used to attach the antenna 60 to a printed circuit board. A reflow soldering process melts the solder on the ground contacts 80 and 82 and the feed contact 84. When the solder hardens, the ground contacts 80 and 82 and the feed contact 84 are electrically connected to their respective traces on the printed circuit board.

Figure 15:
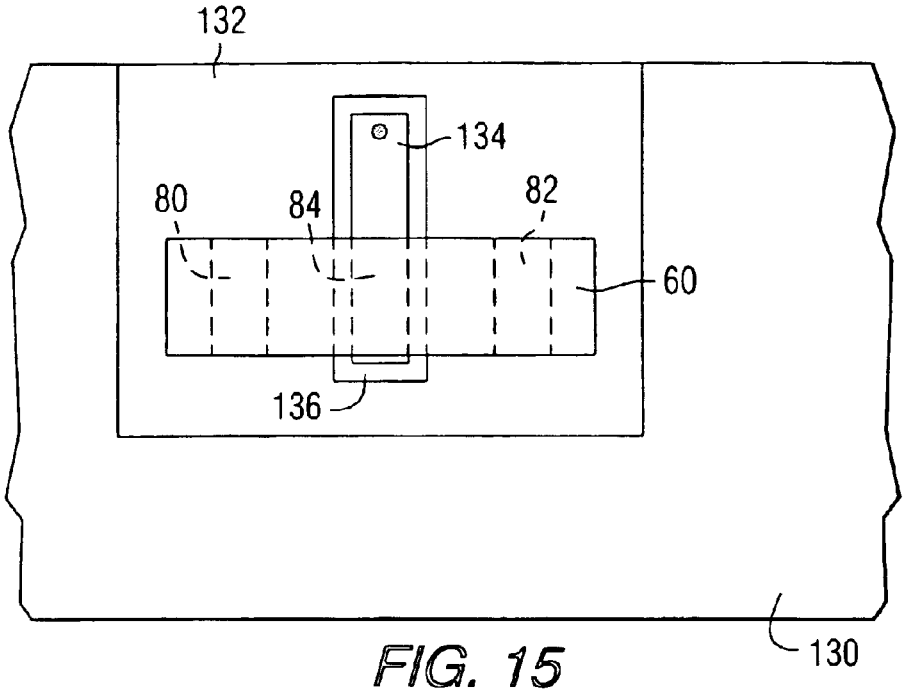

FIG. 15 illustrates the antenna 60 attached to a printed circuit board 130 of a wireless communications device. Note that the ground contacts 80 and 82 of the antenna 60 are electrically connected to the printed circuit board ground plane 132. Also, the antenna feed contact 84 is electrically connected to a feed trace 134 disposed on the printed circuit board 130. A gap 136 separates the ground plane 132 from the feed trace 134.

One embodiment of an antenna constructed according to the teachings of the present invention has approximate dimensions of 0.2 inches deep, 0.6 inches wide and 0.18 inches high. This antenna operates at a center frequency of approximately 5.25 GHz with a bandwidth of approximately 200 MHz. The bandwidth and center frequency can be adjusted by changing the distance between and the shape of the various antenna elements.

Figure 16:
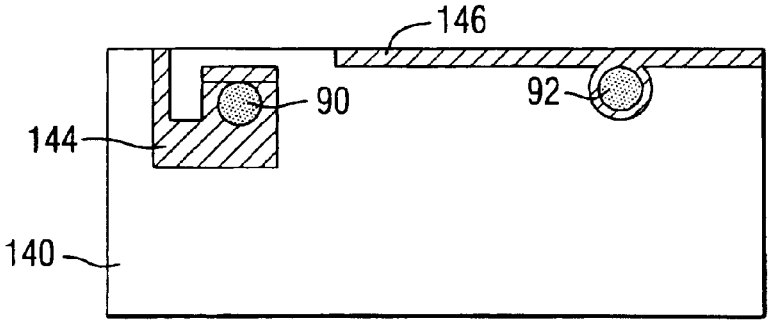
FIGS. 16 and 17 illustrate patterned interior surface configurations of another embodiment of a low-profile dielectrically-loaded meanderline antenna constructed according to the teachings of the present invention.
Figure 17:
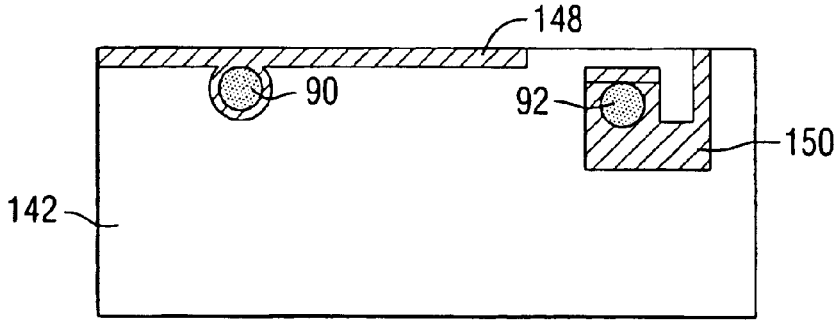

Alternate conductive patterns for the surfaces 74 and 76 are illustrated in FIGS. 16 and 17, respectively. Thus the conductive patterns on the surfaces 140 and 142, which are employed in lieu of the patterned layers on the surfaces 76 and 74, respectively, can be formed by a simple change to the etch mask.

The patterned layer 140 comprises a conductive pad 144 and a conductive strip 146. Note the via 92 is electrically connected to the conductive strip 146, whereas on the surface 76 the conductive via 92 is not connected to the conductive strip 92. The surface 142, includes a conductive strip 148 and a conductive pad 150.

Although an antenna constructed using the patterned layers on the surfaces 140 and 142 has the same general operational parameters as an antenna using the patterned layers on the surfaces 74 and 76, the embodiment of FIGS. 16 and 17 changes the bandwidth and the antenna center frequency due at least in part to the electrical connection from the via 92 to the conductive strip 146 to the top plate 66 in the surface 140, and from the via 90 to the conductive strip 148 to the top plate 66 in the surface 142. Note that in the patterned layers on the surfaces 74 and 76 these vias are only electromagnetically coupled to the top plate 66. Also, the conductive pads 144 and 150 are shaped differently than the conductive pads 110 and 114. However, the orientation and spacing of the ground contacts 80 and 82 and the feed contact 84 (referred to collectively as the antenna footprint) remains unchanged for the antenna embodiment using the patterned layers on the surfaces 140 and 142. Thus a common mating conductive pattern in the wireless device allows for the insertion of either antenna.

The antenna 60 constructed in accordance with the elements illustrated in FIGS. 8 and 9, including the conductive patterns on the surfaces 74 and 76, radiates primarily from the feed plate 68 and the ground plate 70, creating an approximately omnidirectional pattern, commonly referred to as the "donut pattern". Because little radiation is emitted from the antenna sides, as formed by the end surfaces of the dielectric layers 61, 62 and 63, the omnidirectional signal strength in those regions is diminished somewhat. Also, little radiation is emitted from the top plate 66 and the bottom surface, i.e., where the ground contacts 80 and 82 and the feed contact 84 is located.

In one application, to create a more symmetrical omnidirectional pattern, two antennas constructed according to the present invention are oriented orthogonally and either driven in parallel or operated by switching between the antennas. In this way, the lower signal strength regions in the pattern of the first antenna are compensated by the second antenna and the resulting combined total radiation pattern more closely approximates a theoretical omnidirectional pattern.

Figure 18:
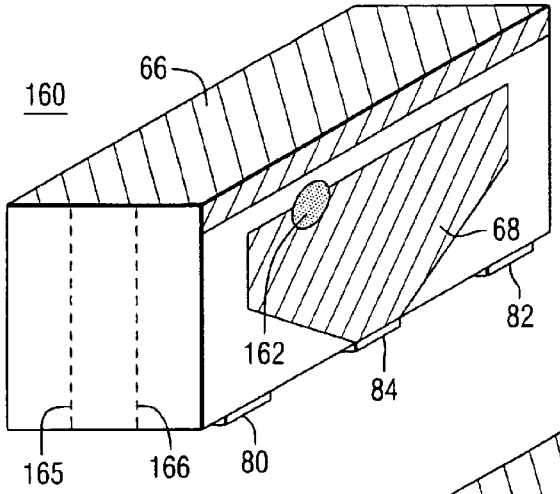
FIGS. 18–21 illustrate surface and interior features of another embodiment of a low-profile dielectrically-loaded meanderline antenna constructed according to the teachings of the present invention.
Figure 19:
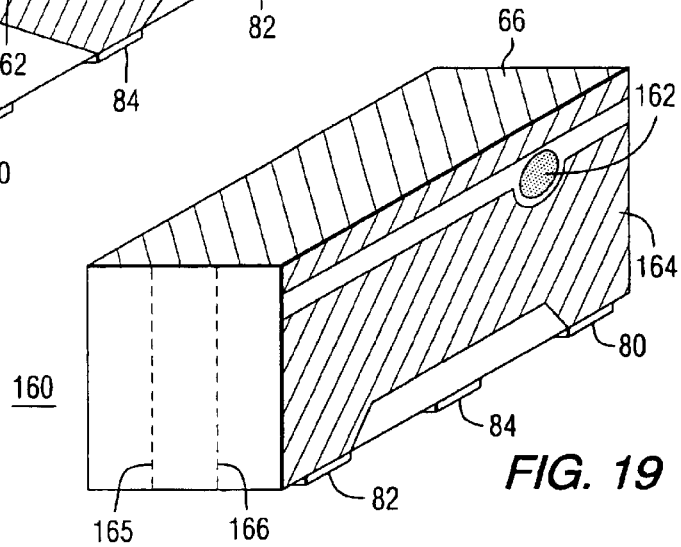

In yet another application, it is desired to radiate (or receive) substantially in the elevation direction and thus the top plate 66 becomes the primary radiating structure. FIGS. 18 and 19 illustrate an embodiment of an antenna 160 where most of the radiation is in the elevation direction, at approximately the same center frequency (approximately 5.25 GHz) and bandwidth as the antenna 60. Note that the antenna 160 comprises only a single via 162 and a ground plate 164 that is not electrically connected to the top plate 66. See FIG. 19. Also, the via 162 is electrically connected to the feed plate 68, but is not electrically connected to the ground plate 164. Advantageously, the antenna 160 shares the same antenna foot print with the antenna 60 and thus both can be mounted on the same printed circuit board trace pattern to provide antenna pattern diversity to the wireless device in which they are installed.

Figure 20:
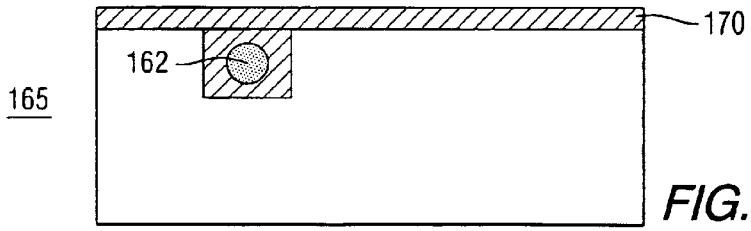
Figure 21:
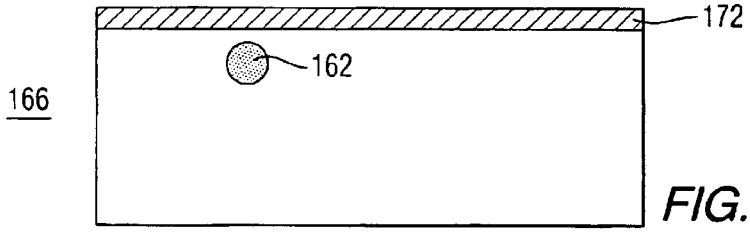

FIGS. 20 and 21 illustrate the conductive patterns for the surfaces 165 and 166 of FIGS. 18 and 19, including a conductive strip 170 connected to the via 162 on the patterned layer 165, and a conductive strip 172 on the patterned layer 166. The antenna 160 radiates a horizontally polarized signal from the top plate 66. Additionally, the antenna 160 can be physically rotated by 90 degrees such that the top plate 66 is oriented vertically to radiate a vertically polarized omnidirectional signal, but the beam width of the pattern is far narrower than the vertically polarized omnidirectional pattern of the antenna 60 embodiment.

When both the antenna 60 and the antenna 160 are incorporated into a wireless device, one or the other antenna can be selected by the wireless device, depending upon the desired direction of maximum signal strength. Further, the combination of the antenna 60 and the antenna 160 mounted orthogonally with respect to each other provides a substantially hemispherical pattern when the antennas are simultaneously driven or switched. Further, the signal polarizations produced by two orthogonally-mounted antennae provides a signal combining function that produces an elliptically or circularly polarized signal.

Figure 22:
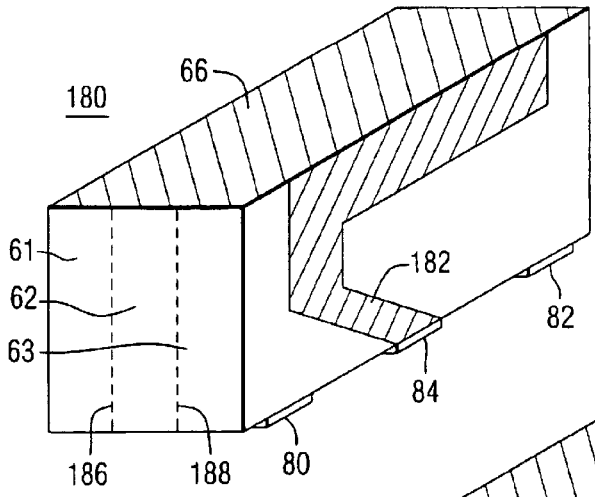
FIGS. 22–25 illustrate surface and interior features of yet another embodiment of a low-profile dielectrically-loaded meanderline antenna constructed according to the teachings of the present invention.
Figure 23:
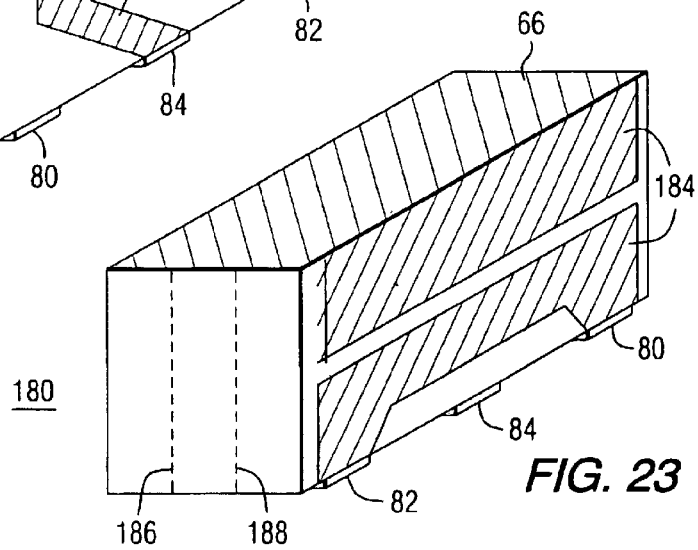

FIGS. 22 and 23 illustrate an antenna 180, another embodiment according to the teachings of the present invention. The antenna 180 comprises a shaped feed plate 182 connected to the feed contact 84 as in the previously-discussed embodiments. A two-part ground plate 184 is electrically connected to the ground contacts 80 and 82, as illustrated in the rear view of FIG. 23. The antenna 180 further includes patterned surfaces 186 and 188 to be described further below.

Figure 24:
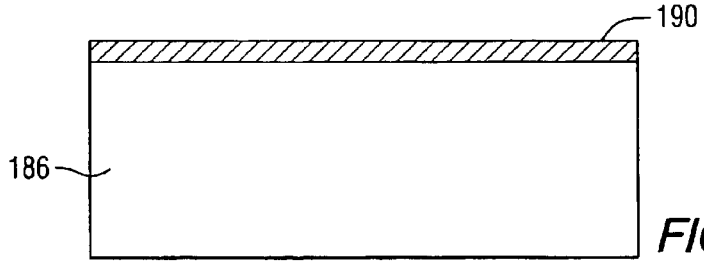
Figure 25:
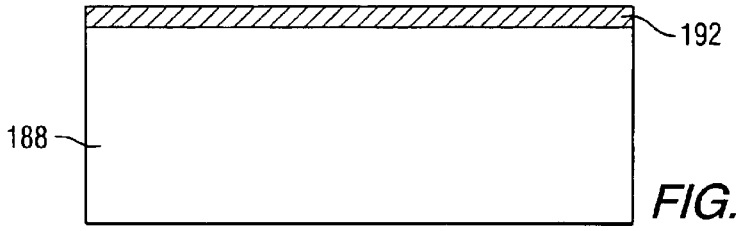

The surface 186 is the interior-facing side of the dielectric layer 61 and includes a conductive strip 190 as shown in FIG. 24. The surface 188 is the interior-facing side of the dielectric layer 63 and includes a conductive strip 192 a shown in FIG. 25. The conductive strips 190 and 192 are electrically connected to the top plate 66 and serve as an anchor for the top plate 66, when formed by electroplating as discussed above. As compared with the previously discussed embodiments, note the absence of vias in the antenna 180.

In another embodiment, the antenna 180 can be formed from a dielectric bulk in lieu of the three dielectric layers 61, 62 and 63. According to this embodiment, the patterned surfaces 186 and 188 are absent, but the top plate 66, the feed plate 182 and the ground plate 184 are formed on the outside surfaces of the dielectric bulk.

In one embodiment the antenna 180 operates at 5.25 GHz with a highly linearized polarization and a unidirectional radiation pattern pointed to the nadir (with a gain of about 4 dBi). Another embodiment with different feature sizes operates at about 5.80 GHz. Since the antenna 180 has a high linearly polarization and a high gain, it is especially suitable for point-to-point communication. Two such antennas can be combined to form a circularly or, more generally, an elliptically polarized wave.

Each of the several different antenna embodiments described herein comprise several different elements that provide advantageous performance characteristics. Elements from one embodiment can be combined with elements from a different embodiment to form yet another embodiment according to the teachings of the present invention. All of these combinations are deemed to fall within the scope of the present invention. For example, one or more conductive vias from the embodiment of the antenna 60 can be added to the antenna 180 to advantageously alter the performance characteristics of the antenna 180.

As shown, according to the present invention, several antenna embodiments have been disclosed. These antennas can be formed with the same footprint, but exhibit different performance characteristics, including radiation pattern, polarization, center frequency and bandwidth, according to the individual features and elements of the antenna, such as the presence or absence of vias, the shape of the feed plate and the ground plate, the conductive pattern on the interior surfaces of the dielectric layers, and the manner in which these conductive patterns are connected to the outer conductive patterns comprising the feed plate and the ground plate. Thus one or more antennas of the various embodiments presented can be combined in a wireless device for imparting desired propagation properties to the device. For example, two highly linearly polarized antennas can be oriented perpendicular to each other to form an antenna that is switchable between the two linear polarizations.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope thereof. For example, depending on the operational mode (i.e., monopole mode or loop mode) certain of the active (radiating or receiving) structures of the antenna (i.e., the top, feed and ground plates) may not be required because little it any radiation is emitted from or received at those structures. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a dielectric substrate;

a first patterned conductive layer disposed on a first surface of the dielectric substrate;

a second patterned conductive layer disposed on a second surface of the dielectric substrates;

a third patterned conductive layer disposed on a third surface of the dielectric substrate;

wherein the first surface is substantially perpendicular to the second and the third surfaces, and wherein the second surface is substantially parallel to the third surface; and wherein the second conductive layer comprises a feed and the third conductive layer comprises a ground.

2. The antenna of clam 1 further comprising a first conductive via extending through the dielectric substrate and electrically connected to the first and the second patterned conductive layers.

3. The antenna of claim 2 wherein the first conductive via extends to the third patterned conductive layer and is insulated therefrom by a region of the dielectric substrate.

4. The antenna of claim 2 further comprising a fourth patterned conductive layer in spaced-apart substantially parallel relation to the second patterned conductive layer and disposed within the dielectric substrate.

5. The antenna of claim 4 further comprising a second conductive via extending through the dielectric substrate and electrically connected to the third and the fourth patterned conductive layers.

6. The antenna of claim 5 wherein the second conductive via extends to the first patterned conductive layer and is insulated therefrom by a region of the dielectric substrate.

7. The antenna of claim 4 further comprising a fifth patterned conductive layer in spaced-apart relation to the second patterned conductive layer and disposed within the dielectric substrate.

8. The antenna of claim 7 wherein the fifth patterned conductive layer is electrically connected to the third patterned conductive layer.

9. The antenna of claim 1 wherein a surface of the dielectric substrate opposite the first patterned conductive layer comprises at least one conductive pad in electrical contact with the second patterned conductive layer and a second conductive pad in electrical contact with the third patterned conductive layer.

10. The antenna of claim 1 wherein the second patterned conductive layer is patterned in the shape of a triangle with the apex of the triangle pointed in a direction away from the first surface.

11. The antenna of claim 1 wherein the second patterned conductive layer comprises a feed plate responsive to signals to be transmitted from the antenna in the transmitting mode and providing signals received by the antenna in the receiving mode, and wherein the third patterned conductive layer comprises a ground plate, and wherein the first patterned conductive layer comprises a top plate.

12. The antenna of claim 7 wherein the fifth and the fourth pattern conductive layers each comprises a conductive strip disposed on an edge thereof and in electrical contact with the first patterned conductive layer.

13. The antenna of claim 12 wherein the fifth and the fourth patterned conductive layers each further comprises a closed curve of conductive material and in electrical contact with the conductive strip.

14. An antenna comprising:

a dielectric substrate including a first, a second, and a third layer;

a shaped conductive feed plate disposed on a first exterior surface of the dielectric substrate;

a shaped conductive ground plate disposed on a second exterior surface of the dielectric substrate, wherein the first surface is in opposing substantially parallel relation to the second surface;

a shaped conductive top plate disposed on a third surface of the dielectric substrate wherein, the third surface is substantially perpendicular to both the first and the second surfaces;

a first shaped conductive pattern disposed between said first and said second dielectric layers;

a second shaped conductive pattern disposed between said second and said third dielectric layers;

a first conductive via extending through the dielectric substrate, wherein said first conductive via is electrically insulated from said feed plate and in electrical contact with said ground plate and further in electrical contact with said first shaped conductive pattern; and a second conductive via extending through said dielectric substrate, wherein said second conductive via is in electrical contact with said feed plate and electrically insulated from said ground plate and further in electrical contact with said second shaped conductive pattern.

15. The antenna of claim 14 wherein the dielectric constant of at least one of the first, second, and third dielectric layers differs from the dielectric constant of the other two dielectric layers.

16. An antenna comprising:

a dielectric substrate;

a shaped conductive layer disposed on at least two exterior surfaces of said dielectric substrate, wherein the at least two shaped conductive layers are in a substantially parallel relation;

a first interior shaped conductive layer disposed within said dielectric substrate and oriented substantially parallel to the at least two shaped conductive layers; and at least one conductive via extending between said two shaped conductive layers and in electrical contact with at least one of said two shaped conductive layers and further in electrical contact with said first interior shaped conductive layer;

wherein one of said two shaped conductive layers comprises a feed and the other of said two shaped conductive layers comprises a ground.

17. The antenna of claim 16 further comprising a second interior shaped conductive layer disposed within said dielectric substrate and substantially parallel to the first interior shaped conductive layer, wherein the at least one conductive via is electrically insulated from said second interior shaped conductive layer.

18. An antenna comprising:

a dielectric substrate;

first, second and third shaped conductive layers on three faces of said dielectric substrate, wherein said first and said second conductive layers are in substantially parallel orientation, and wherein said third conductive layer is oriented substantially perpendicular to said first and said second conductive layers;

fourth and fifth shaped conductive layers disposed within said dielectric substrate and oriented parallel to said first and said second conductive layers;

a first conductive via formed within said dielectric substrate and extending between said first and said second conductive layers; and a second conductive via extending from the first to the second shaped conductive layer, wherein the first conductive via is in electrical contact with the first shaped conductive layer and electrically insulated from the second shaped conductive layer, and wherein said second conductive via is in electrical contact with the second shaped conductive layer and electrically insulated from the first shaped conductive layer.

19. The antenna of claim 18 wherein the first and the second conductive layers are in electrical contact with the third conductive layer.

20. The antenna of claim 18 wherein the first and the second conductive layers are insulated from electrical contact with the third conductive layer.

21. The antenna of claim 18 wherein one of the first and the second conductive layers is in electrical contact with the third conductive layer and the other of the first and the second conductive layers is electrically insulated from the third conductive layer.

22. The antenna of claim 18 wherein the first conductive layer comprises a ground plate, and wherein the second conductive layer comprises a feed plate, and wherein the third conductive layer comprises a top plate.

23. The antenna of claim 22 wherein the ground plate comprises a first portion electrically connected to the top plate and a second portion below said first portion and electrically insulated from the first portion.

24. The antenna of claim 22 wherein the feed plate comprises a generally rectangular first portion and a relatively narrower second portion extending therefrom.

25. The antenna of claim 18 wherein the first conductive via is electrically insulated from the fourth shaped conductive layer and electrically connected to the fifth shaped conductive layer.

26. A wireless device selectably operative in a receiving mode for receiving electromagnetic energy and operative in a transmitting mode for transmitting electromagnetic energy, comprising:

an antenna comprising:

a dielectric substrate;

at least one exterior patterned conductive layer disposed on a first surface of said dielectric substrate;

at least one interior patterned conductive layer disposed within said dielectric substrate and oriented substantially parallel to said at least one exterior patterned conductive layer;

at least one conductive via formed within said dielectric substrate; and a feed conductive pad and a ground conductive pad both formed on a second surface of the dielectric substrate for connection to the wireless device, wherein said first and said second surfaces are substantially perpendicular.

27. The wireless device of claim 26 wherein the at least one exterior patterned conductive layer comprises a first and a second exterior patterned conductive layer disposed on spaced-apart substantially parallel surfaces of the dielectric substrate.

28. The wireless device of claim 26 further comprising a source electrically connected to the first exterior patterned conductive layer and a ground plane electrically connected to the second exterior patterned conductive layer.

29. The wireless device of claim 27 further comprising a third patterned conductive layer disposed on a surface of the dielectric substrate substantially perpendicular to the first and the second exterior patterned conductive layers.

30. The wireless device of claim 27 wherein the at least one interior patterned conductive layer comprises a first and a second interior patterned conductive layer.

31. The wireless device of claim 30 wherein the at least one conductive via comprises a first and a second conductive vias.

32. The wireless device of claim 31 wherein the first conductive via is electrically connected to the first exterior patterned conductive layer and to the first interior patterned conductive layer, and wherein the second conductive via is electrically connected to the second exterior patterned conductive layer and to the second interior patterned conductive layer.

* * * * *